US008115682B2

(12) United States Patent
Chang et al.

(10) Patent No.: US 8,115,682 B2
(45) Date of Patent: Feb. 14, 2012

(54) MULTI-BAND HAC COMPATIBLE ANTENNA MODULE

(75) Inventors: Daniel Chang, Pa-Te (TW); Chia-Lun Tang, Pa-Te (TW); Yan-Wen Zhao, Chengdu (CN); Jianliang Shen, Chengdu (CN)

(73) Assignee: Auden Techno Corp., Pa-Te, Tao-Yuan Hsien (TW)

( * ) Notice: Subject to any disclaimer, the term of this patent is extended or adjusted under 35 U.S.C. 154(b) by 416 days.

(21) Appl. No.: 12/344,718

(22) Filed: Dec. 29, 2008

(65) Prior Publication Data

US 2010/0164808 A1 Jul. 1, 2010

(51) Int. Cl.
*H01Q 9/84* (2006.01)

(52) U.S. Cl. ..... 343/700 MS; 343/702; 343/767

(58) Field of Classification Search ..... 343/700 MS, 343/702, 767
See application file for complete search history.

(56) References Cited

U.S. PATENT DOCUMENTS

| | | | | |
|---|---|---|---|---|
| 2006/0140428 | A1 | 6/2006 | Qi et al. | |
| 2006/0284770 | A1 * | 12/2006 | Jo et al. | 343/700 MS |
| 2007/0003088 | A1 | 1/2007 | Lehtola | |
| 2009/0232337 | A1 * | 9/2009 | Tang | 381/312 |
| 2010/0033380 | A1 * | 2/2010 | Pascolini et al. | 343/700 MS |
| 2010/0109953 | A1 * | 5/2010 | Tang | 343/700 MS |

* cited by examiner

*Primary Examiner* — Douglas W Owens
*Assistant Examiner* — Chuc Tran
(74) *Attorney, Agent, or Firm* — Guice Patents PLLC

(57) ABSTRACT

A multi-band HAC compatible antenna module having a metal shield arranged around the built-in antenna for resonant coupling with the antenna to lower electromagnetic interference and to improves hearing aids compatibility characteristic. When compared with a reference antenna without metal shield, the multi-band HAC compatible antenna module shows 3 dB~4 dB HAC improvement in GSM850 and GSM900, and 1 dB HAC improvement in DCS and PCS bands.

6 Claims, 10 Drawing Sheets
(4 of 10 Drawing Sheet(s) Filed in Color)

Peak E-field in V/m
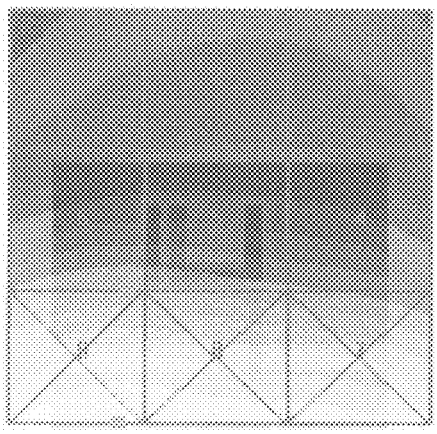
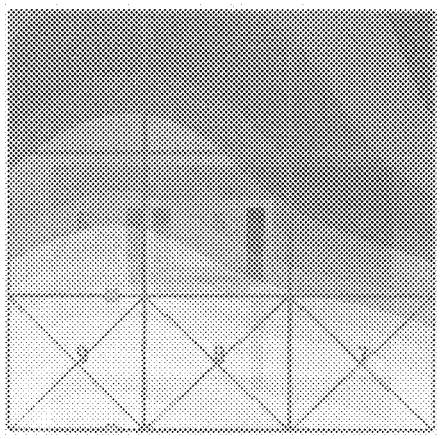
Peak H-field in A/m
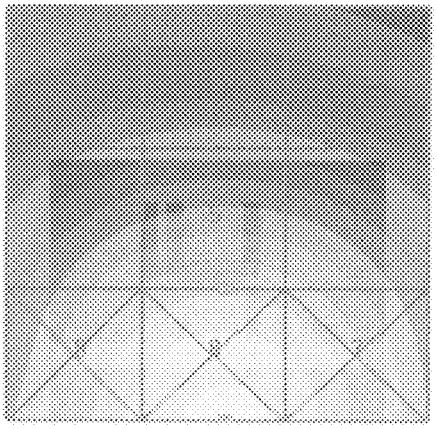
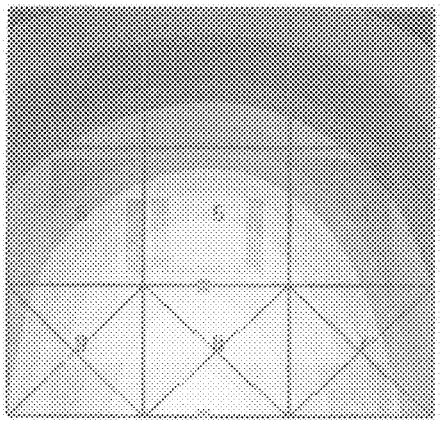
FIG. 10(a) FIG. 10(b)

MULTI-BAND HAC COMPATIBLE ANTENNA MODULE

BACKGROUND OF THE INVENTION

1. Field of the Invention

The present invention relates to antenna module designs and more particularly, to a multi-band HAC compatible antenna module, which has a metal shield mounted therein around the built-in antenna for resonant coupling with the antenna to lower electromagnetic interference and to provide HAC characteristic.

The patent or application file contains at least one drawing executed in color. Copies of this patent or patent application publication with color drawing(s) will be provided by the Office upon request and payment of the necessary fee.

2. Description of the Related Art

FCC (Federal Communications Commission) introduced new regulations regarding digital cellular telephones. In order not to interfere with concomitant use of a cellular telephone and hearing aids, cellular telephone providers are responsible to keep EMI (electromagnetic interference) below a certain level. Cellular telephone provides are also requested to prepare some types of cellular telephones for enabling audio signal to be transmitted to hearing aids by means of telcoil coupling.

FCC established the aforesaid regulations just because analog cellular telephones are being disappeared from the market FCC indicates no significant problems are found during the concomitant use of an analog cellular telephone and hearing aids.

With respect to the problem of concomitant use between cellular telephones and hearing aids, ANSI (American National Standards Institute) established compatibility between hearing aids and cellular telephone under "ANSI C63.19".

Regular cell phone antennas cannot meet HAC (Hearing Aids Compatibility) standards. Therefore, HAC compatible cellular telephones are continuously created. US20060140428 discloses a mobile wireless communications device including an upper housing and a lower housing being slidably connected together for sliding between a retracted position and an extended use position.

US20070003088 discloses an electronic device including a ground plane with two opposed edges, an electrical component, and an electrical conductor coupling the electrical component to a point on the ground plane that is substantially spaced from each of the opposed edges. These methods are not applicable to antenna designs for straight cellular telephone for improving HAC characteristic.

The built-in antennas of regular straight cellular telephones show low performance in HAC. The HAC design of a single-pole antenna for straight cellular telephone does not have a reference ground plane, resulting in a high field strength at the reference location that is disposed near the antenna.

SUMMARY OF THE INVENTION

The present invention has been accomplished under the circumstances in view. It is one object of the present invention to provide a multi-band HAC compatible antenna module, which is mounted with a metal shield to provide excellent HAC characteristic, showing 3 dB~4 dB HAC improvement in GSM850 and GSM900, and 1 dB HAC improvement in DCS and PCS bands when compared with a reference antenna without metal shield.

To achieve this and other objects of the present invention, a multi-band HAC compatible antenna module includes a dielectric substrate, which has a metal ground covered on a part thereof, an antenna holder protruded from the dielectric substrate beyond the cover range of the metal ground, a single-pole antenna mounted in the antenna holder and adapted to produce a radiation in GSM850, GMS900, DCS and PCS bands, a microband feed line connected to the single-pole antenna for feeding in signals, and a metal shield mounted in the dielectric substrate opposite to the antenna holder for resonant coupling with the single-pole antenna to lower electromagnetic interference and to improve hearing aids compatibility characteristic.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

FIG. 5(*b*) is a side view of FIG. 5(*a*).

FIG. 6(*b*) illustrates the HAC test result of the reference antenna module without metal shield in 925 MHz according to the present invention.

FIG. 7(*b*) illustrates the HAC test result of the reference antenna module without metal shield in 1850.2 MHz according to the present invention.

FIG. 10(*a*) illustrates the near-field field-strength RMS value at 1850.2 MHz of the multi-band HAC compatible antenna module according to the present invention.

FIG. 10(*b*) illustrates the near-field field-strength RMS value at 1850.2 MHz of the reference antenna module without metal shield according to the present invention.

DETAILED DESCRIPTION OF THE PREFERRED EMBODIMENT

Figure 1:
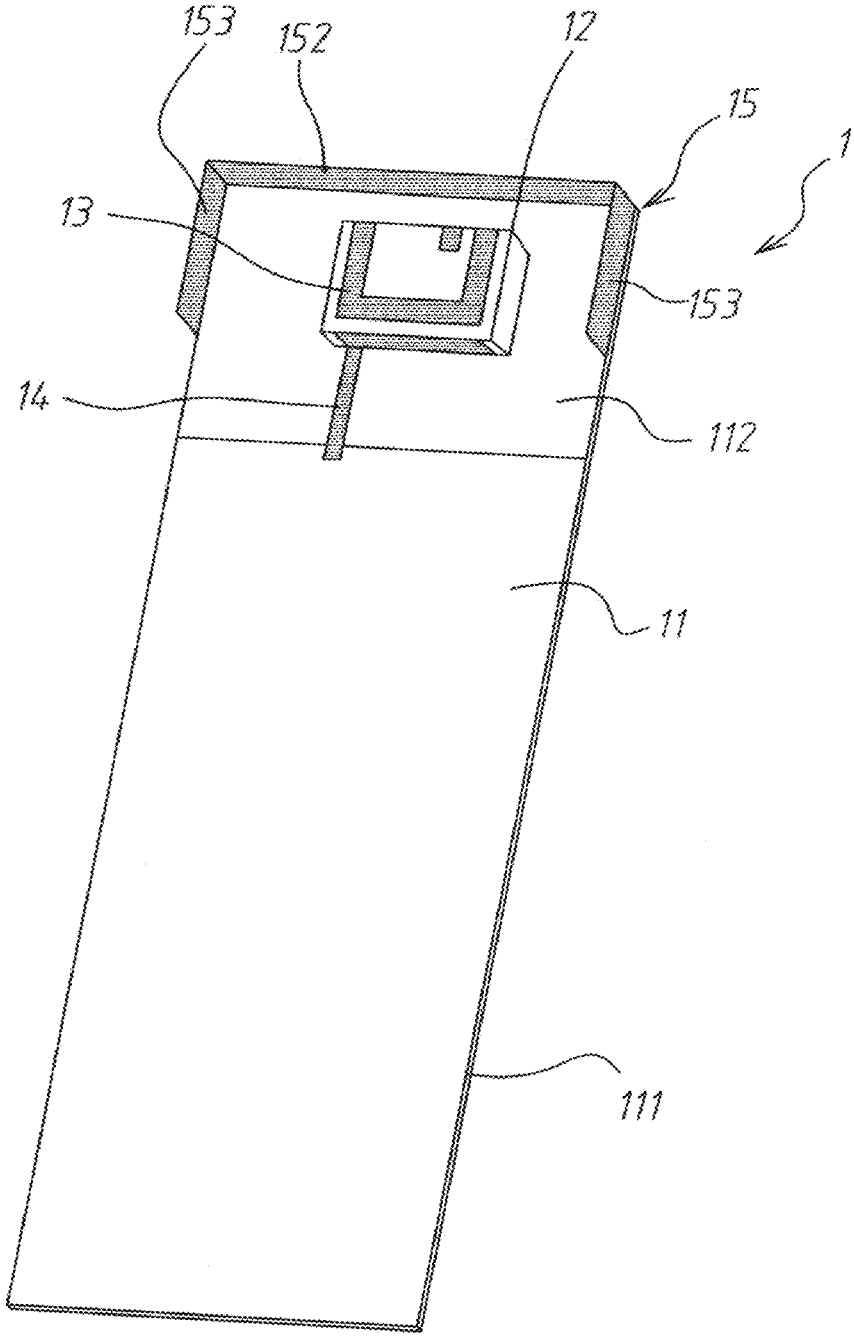
FIG. 1 is an oblique front elevation of a multi-band HAC compatible antenna module in accordance with the present invention.
Figure 2:
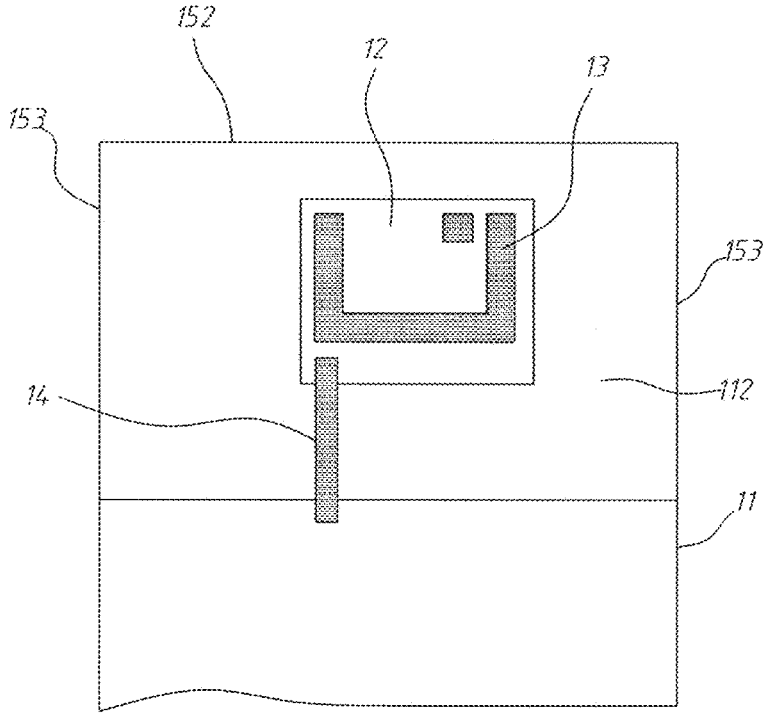
FIG. 2 is a top plain view of a part of the multi-band HAC compatible antenna module according to the present invention.
Figure 3:
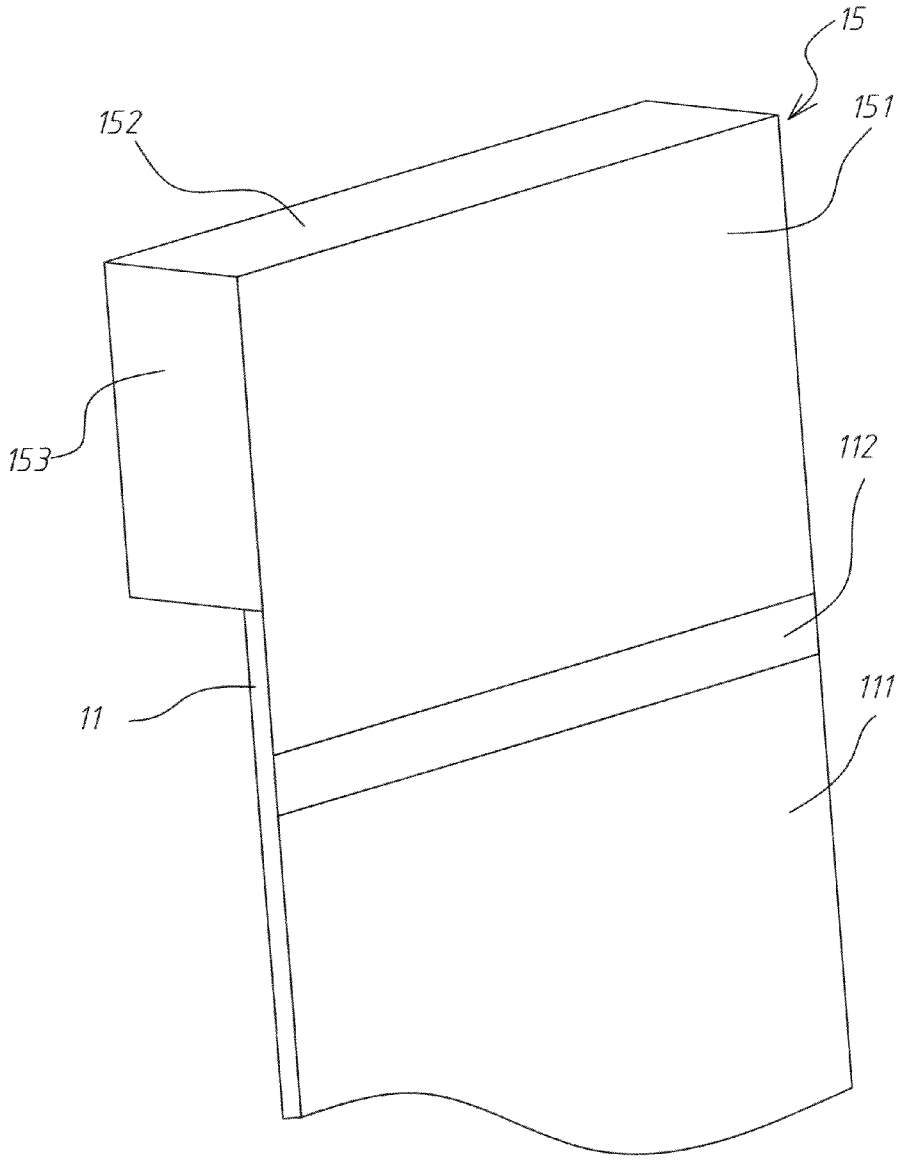
FIG. 3 is a rear elevation of a part of the multi-band HAC compatible antenna module according to the present invention.

Referring to FIGS. 1~3, an antenna module 1 includes a dielectric substrate 11, an antenna holder 12, a single-pole antenna 13, a microband feed line 14, and a metal shield 15.

The dielectric substrate 11 has a metal ground 111 covered on a part thereof. According to this embodiment, as shown in FIG. 3, the metal ground 111 is covered on a part of the back side of the dielectric substrate 11. The part of the dielectric substrate 11 beyond the metal ground 111 is the non-metal ground part 112. Further, the dielectric substrate 11 is made of FR4 (Flame Retardant 4).

The antenna holder 12 is made of an electrically insulative material and protruded from one side, for example, the front side of the non-metal ground part 112.

Figure 5B:
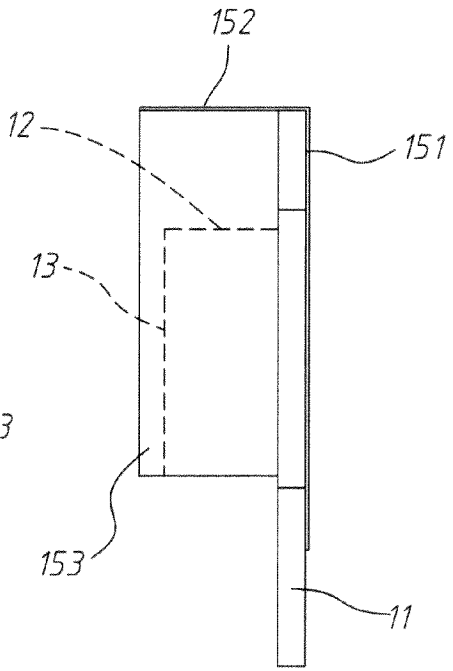
FIG. 5(*a*) is a perspective view of the present invention, showing the relationship between the single-pole antenna and the metal shield.
Figure 5A:
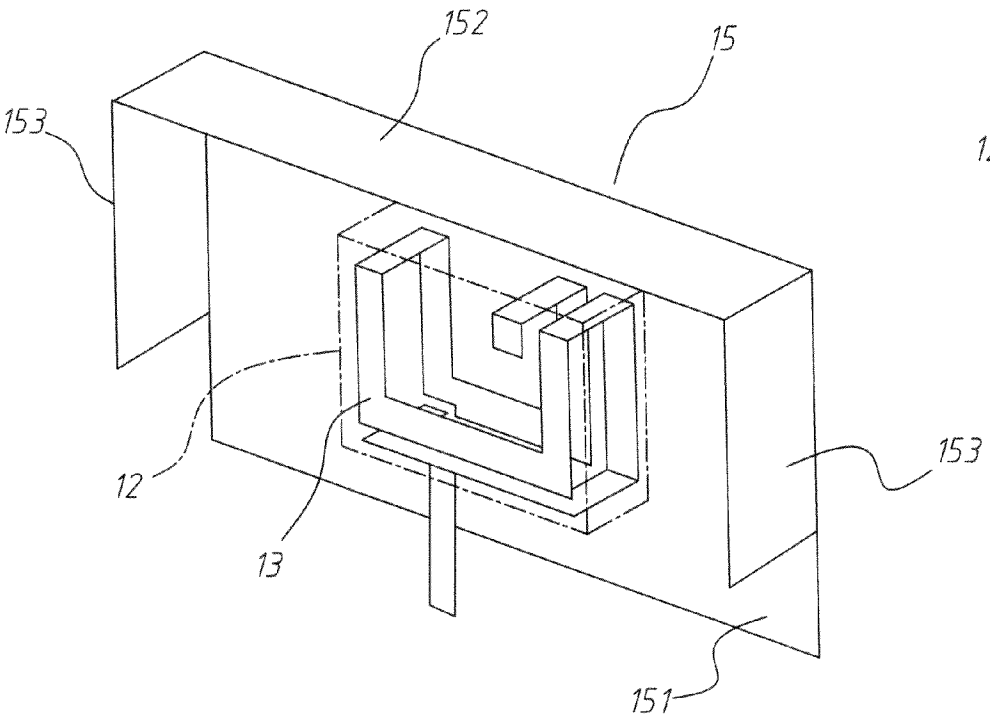

The single-pole antenna 13 is installed in the antenna holder 12. As shown in FIGS. 5(*a*) and 5(*b*), the single-pole antenna 13 wound on the antenna holder 12 and adapted to generate radiation for applications in GSM, DCS and PCS bands.

The microband feed line 14 is connected to the single-pole antenna 13 for feeding in signals.

The metal shield 15 is mounted on the non-metal ground part 112 of the dielectric substrate 11 at the opposite side relative to the single-pole antenna 13 for resonant coupling with the single-pole antenna 13 to lower electromagnetic interference, improving HAC (Hearing Aids Compatibility) characteristic.

Figure 4:
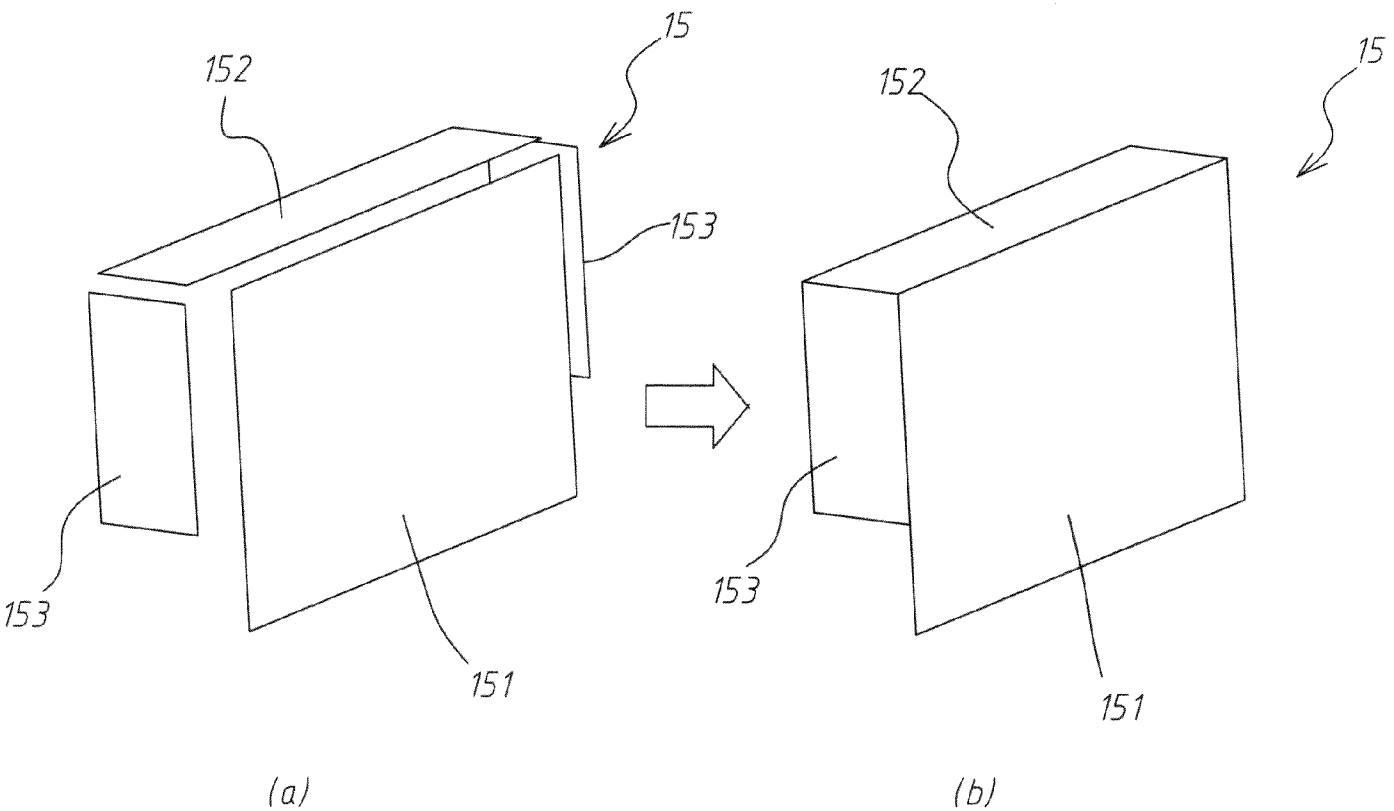
FIG. 4 illustrates the arrangement of the component parts of the metal shield of the multi-band HAC compatible antenna module according to the present invention.

Referring to FIGS. 4(*a*) and 4(*b*), the metal shield 15 extends around the single-pole antenna 13. As illustrated, the metal shield 15 includes:

a metal sheet 151 covered on the back side of the non-metal ground part 112 of the dielectric substrate 11 opposite to the single-pole antenna 13;

a top metal strip 152 connected to the metal sheet 151 at right angles; and two side metal strips 153 perpendicularly extended from the metal sheet 151 and respectively perpendicularly connected to the two distal ends of the top metal strip 152.

The top metal strip 152 and the side metal strips 153 perpendicularly extend along the border of the metal sheet 151 around the single-pole antenna 13, providing an excellent EMI-protective shielding effect to the single-pole antenna 13.

Further, the distance between the single-pole antenna 13 and the metal sheet 151 of the metal shield 15 is approximately equal to the thickness of the dielectric substrate 11, for example, 1 mm.

The antenna holder 12 is filled up with a dielectric material. The dielectric parameters may be adjusted subject to requirements, for enabling the single-pole antenna 13 to work in GSM850, GSM900, DCS and PCS bands.

Further, when designing the antenna module, adjust the dielectric material in the antenna holder 12 subject to the radiation length of the reference single-pole antenna to have the single-pole antenna 13 produce a resonant frequency slightly above the desired working band, and then adjust the coupling between the metal shield 15 and the single-pole antenna 13 to shift the resonance toward the desired working frequency, thereby improving HAC characteristic.

When testing an antenna module with the metal shield and an antenna module without the metal shield, a near-field field-strength comparison chart is obtained as follows:

| Frequency | With/Without metal shield | Total efficiency | HAC E-field(V/m) | HAC H-field(A/m) |
|---|---|---|---|---|
| 925 MHz | Yes | 88.06% | 336 | 0.729 |
| 925 MHz | No | 88.46% | 498 | 0.818 |
| 1850.2 MHz | Yes | 86.20% | 110 | 0.318 |
| 1850.2 MHz | No | 82.01% | 123 | 0.347 |

Figures 9A, 9B:
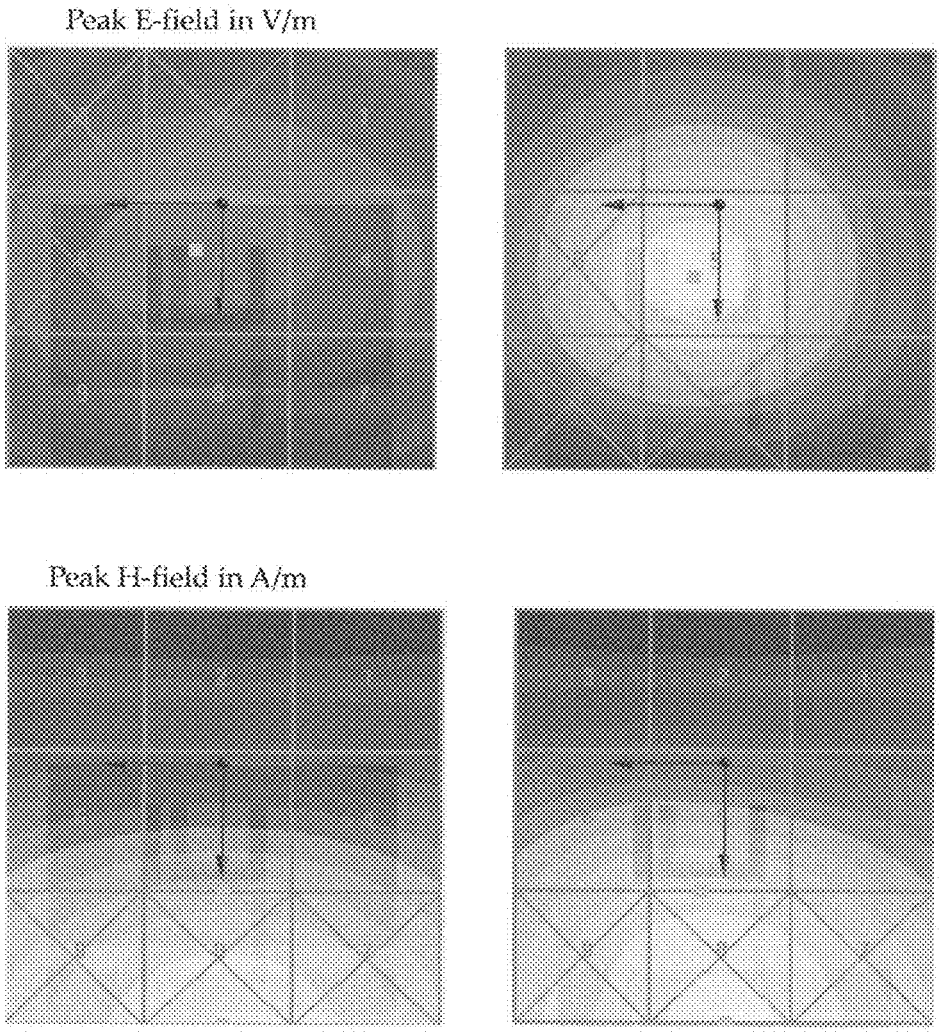
FIG. 9(*b*) illustrates a near-field field-strength at 925 MHz of the reference antenna module without metal shield according to the present invention.

Based on the reference antenna (antenna module without metal shield) without changing the other structure, the installation of the metal shield 15 effectively improves the performance of the antenna module in HAC. FIG. 9 illustrates the near-field field-strength at 925 MHz of the reference antenna without metal shield and the antenna with the metal shield. FIG. 9(*a*) illustrates the performance of the antenna with the metal shield. FIG. 9(*b*) illustrates the performance of the reference antenna without metal shield.

FIG. 10 illustrates the near-field field-strength RMS value of the reference antenna without metal shield and the antenna with the metal shield at 1850.2 MHz. FIG. 10(*a*) illustrates the performance of the antenna with the metal shield. FIG. 10(*b*) illustrates the performance of the reference antenna without metal shield. As illustrated, the invention shows an improvement of 4 dB at low frequency, and 1 dB at high frequency.

Further, the non-metal ground part 112 of the dielectric substrate 11 has sufficient space for the installation of other components such as speaker and CCD (charge-coupled device). According to tests, HAC variation is within 1% after installation of a speaker and a CCD in the antenna module.

FIG. 5 shows the relative positioning between the metal shield 15 and the single-pole antenna 13. As shown in FIG. 5(*a*), the distance between the single-pole antenna 13 and microband feed line 14 and the metal shield 15 is about 1 mm. As shown in FIG. 5(*b*), the distance between the single-pole antenna 13 and the metal shield 15 is just equal to the thickness of the dielectric substrate 11, i.e., 1 mm.

As stated above, the invention is based on the reference antenna module and with added metal shield 15 to improve HAC characteristic. At first, adjust the radiation length of the reference single-pole antenna 13. The dielectric material field in the antenna holder 12 is then adjusted to have the single-pole antenna 13 produce a resonant frequency slightly above the desired working band. Thereafter, the metal shield 15 is added to the module. By means of coupling between the metal shield 15 and the single-pole antenna 13, the actual working frequency of the antenna module is shifted downwards to the desired range. Because the metal shield 15 is disposed near the single-pole antenna 13, SII parameters may become worse. Matching adjustment is necessary to have the antenna module function normally in the desired frequency band.

Figure 8:
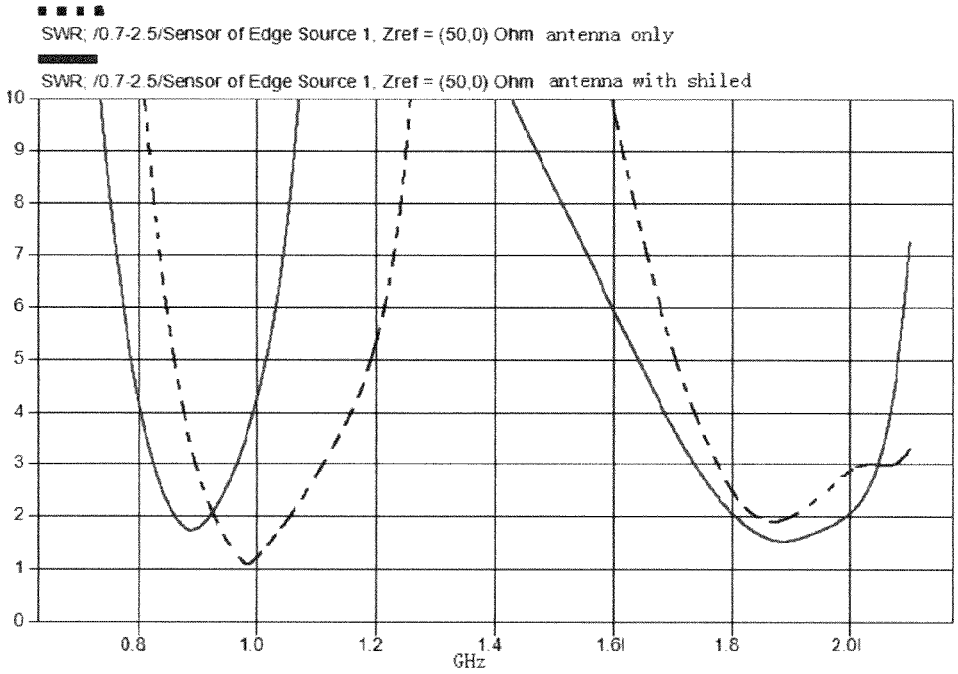
FIG. 8 is a stationary wave ratio comparison chart between the multi-band HAC compatible antenna module and the reference antenna module without metal shield according to the present invention FIG. 9(*a*) illustrates a near-field field-strength at 925 MHz of the multi-band HAC compatible antenna module according to the present invention.

Further, FIG. 8 illustrates the SII parameters of the reference antenna without shield and the antenna with the metal shield 15. The antenna with the metal shield 15 shows stationary wave ratio below 4 when working in GSM850, GSM900, DCS and PCS bands.

Figure 6A:
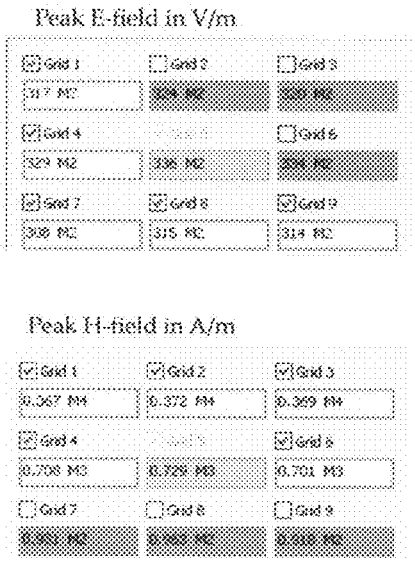
FIG. 6(*a*) illustrates the HAC test result of the multi-band HAC compatible antenna module in 925 MHz according to the present invention.
Figure 6B:
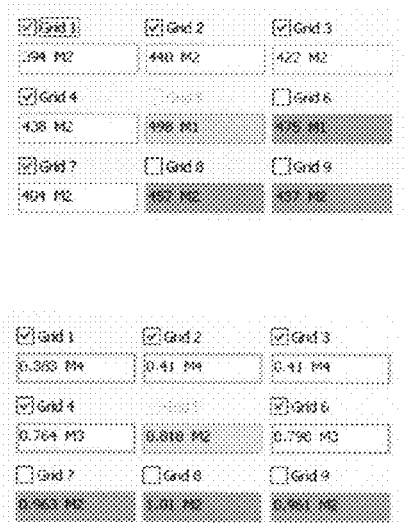
Figure 7A:
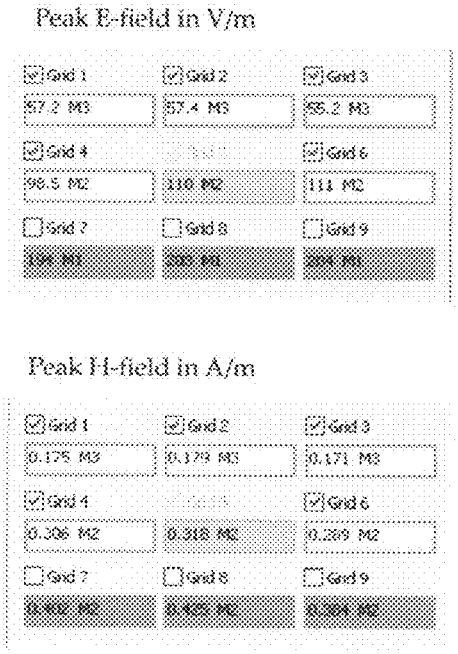
FIG. 7(*a*) illustrates the HAC test result of the multi-band HAC compatible antenna module in 1850.2 MHz according to the present invention.
Figure 7B:
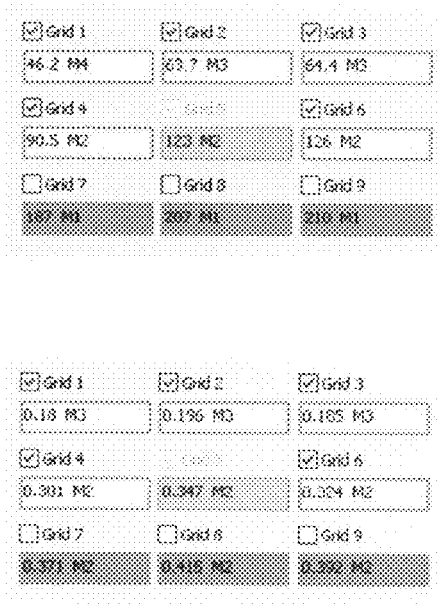

FIGS. 6 and 7 show HAC test results of the antenna module on radiation efficiency, matching efficiency, total efficiency and E-field and H-field in 925 MHz and 1850.2 MHz. The rest results show an improvement of 3 dB~4 dB at low frequency band and 1 dB at high frequency band.

Further, a matching circuit or slot (not shown) may be formed in the dielectric substrate 11, increasing the bandwidth of the antenna module.

A prototype of multi-band HAC compatible antenna module has been constructed with the features of FIGS. 1~10. The multi-band HAC compatible antenna module functions smoothly to provide all of the features disclosed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A multi-band HAC compatible antenna module, comprising:

a dielectric substrate, said dielectric substrate comprising a first substrate part, a second substrate part, and a metal ground covered on at least a part of the surface of said first substrate part;

an antenna holder protruded from a first side of said second substrate part of said dielectric substrate, said antenna holder being electrically insulative;

a single-pole antenna mounted in said antenna holder and adapted to produce a radiation in GSM850, GMS900, DCS and PCS bands;

a microband feed line connected to said single-pole antenna for feeding in signals; and a metal shield mounted in a second side of said second substrate part of said dielectric substrate opposite to said antenna holder for resonant coupling with said single-pole antenna to lower electromagnetic interference and to improve hearing aids compatibility characteristic, wherein the distance between said single-pole antenna and said metal shield is 1 mm and equal to the thickness of said dielectric substrate, wherein said antenna holder is filled with a dielectric material, said dielectric material having parameters adjustable to have said single-pole antenna work in the desired frequency, wherein when adjusting the radiation length of said single-pole antenna and the parameters of said dielectric material in said antenna holder to have said single-pole antenna produce a resonant frequency above the desired working band and then adjusting the coupling between said metal shield and said single-pole antenna to shift the resonance toward the desired working frequency, the HAC characteristic of the antenna module is improved.

2. The multi-band HAC compatible antenna module as claimed in claim 1, wherein said single-pole antenna is wound on said antenna holder.

3. The multi-band HAC compatible antenna module as claimed in claim 1, wherein said metal shield extends around said single-pole antenna.

4. The multi-band HAC compatible antenna module as claimed in claim 3, wherein said metal shield comprises a metal sheet covered on the second side of said second substrate part of said dielectric substrate opposite, a top metal strip connected to one side of said metal sheet at right angles, and two side metal strips perpendicularly extended from said metal sheet and respectively perpendicularly connected to two distal ends of said top metal strip, said top metal strip and said side metal strips being arranged around said single-pole antenna.

5. The multi-band HAC compatible antenna module as claimed in claim 1, wherein said dielectric substrate has a matching circuit installed therein to increase bandwidth.

6. The multi-band HAC compatible antenna module as claimed in claim 1, wherein said dielectric substrate has a slot formed therein to increase bandwidth.

* * * * *